United States Patent [19]

Hatagishi

[11] Patent Number: 4,570,335

[45] Date of Patent: Feb. 18, 1986

[54] APPARATUS FOR INSERTING SLIDER FOR CONCEALED FASTENER

[75] Inventor: Shingo Hatagishi, Toyama, Japan

[73] Assignee: Yoshida Kogyo K.K., Tokyo, Japan

[21] Appl. No.: 675,602

[22] Filed: Nov. 28, 1984

[30] Foreign Application Priority Data

Dec. 23, 1983 [JP] Japan ..... 58-243374

[51] Int. Cl.[4] ..... A41H 37/06

[52] U.S. Cl. ..... 29/768; 29/33.2; 29/766

[58] Field of Search ..... 29/33.2, 408–410, 29/766–770

[56] References Cited

U.S. PATENT DOCUMENTS

| | | | |
|---|---|---|---|
| 4,190,944 | 3/1980 | Yoshida et al. | 29/408 |
| 4,286,382 | 9/1981 | Ueda | 29/768 |
| 4,361,946 | 12/1982 | Takamatsu | 29/408 |
| 4,466,168 | 8/1984 | Hatagishi | 29/768 |

*Primary Examiner*—Howard N. Goldberg
*Assistant Examiner*—Steven Nichols
*Attorney, Agent, or Firm*—Hill, Van Santen, Steadman & Simpson

[57] ABSTRACT

A fastener slider inserting apparatus inserts a slider into a continuous concealed fastener chain alternately having element rows interlocked with each other and space portions in which no element is present. The apparatus has a slider holding device which includes: a slider holder which is adapted to receive a slider from a slider supply device and to support the same, with a pull of the slider hanging down; a device which moves the holder between an upper position where the slider is upwardly separate from the fastener chain and a lower position where the slider is in contact with the fastener chain so that bead portions of the fastener chain are allowed to be inserted into a channel in the slider; a pull guide having a pull groove which houses the pull of the slider; and a device which moves the pull guide between a lower position where the pull guide is downwardly separate from the fastener chain and an upper position where the pull guide extends such as to pass through one of the space portions of the fastener chain and to come in contact with or be adjacent to the slider within the slider holder. When the pull guide is moved from the upper position to the lower position, the slider holder is moved from the upper position to the lower position together with the pull guide.

3 Claims, 15 Drawing Figures

APPARATUS FOR INSERTING SLIDER FOR CONCEALED FASTENER

BACKGROUND OF THE INVENTION

The present invention relates to an apparatus for inserting a slider into a fastener chain in which elements on right and left fastener stringers which in combination constitute a concealed fastener are interlocked with each other, from a space portion of the fastener chain in which no element is present.

DESCRIPTION OF THE PRIOR ART

When a slider is to be inserted into a continuous fastener chain in the state wherein fastener elements are interlocked with each other, it is desirable from the viewpoint of operating efficiency to effect a slider insertion operation without any need for once separating the fastener chain into individual fastener stringers. In a concealed fastener chain, however, the fastener elements lie on one of the sides of a fastener tape; consequently, it is necessary to retain the body of the slider to be inserted on the same side of the fastener tape, while the slider pull is required to lie on the other side of the fastener tape. Accordingly, when the slider is inserted, it is necessary first to pass the slider pull through the gap between two strips of the fastener tape at a space portion in which no element is present. Since it is difficult to automatically pass the slider pull through the gap between the tape strips, it is conventional practice to manually conduct a so-called forward insertion in which the fastener chain is inserted into the channel in the slider from a narrower opening thereof and is pulled out from a wider opening thereof while being separated into two fastener stringers. Thus, it has been desired to develop an apparatus which is capable of automatically effecting the above-described forward insertion.

It is to be noted that examples of known apparatuses which make it possible to improve the efficiency of insertion of the slider of the concealed fastener include those mentioned in the specifications of Japanese Utility Model Publication No. 15299/1972 (Publication Date: May 31, 1972) and Japanese Utility Model Publication No. 4812/1976 (Publication Date: Feb. 10, 1976). In both the known apparatuses, the slider is supported such as to conduct a so-called reverse insertion in which the fastener stringers are inserted into the slider from the wider opening of the channel thereof so that the elements are interlocked with each other, and then the engaged fastener stringers are pulled out from the narrower opening of the channel. Thus, there is no apparatus which is capable of inserting the slider into the concealed fastener chain in a forward insertion manner as described above.

SUMMARY OF THE INVENTION

Accordingly, it is a primary object of the present invention to provide a slider inserting apparatus which is capable of automatically inserting a slider into a concealed fastener chain in a forward insertion manner.

To this end, according to the present invention, a pull guide provided with a pull groove for housing the pull of a slider is provided such as to extend from one (referred to as a "first side", hereinafter) of the sides of a fastener chain to the other side (referred to as a "second side", hereinafter) thereof while passing through the gap between two strips of fastener tape, and the pull of the slider is housed on the second side, the slider being supported by a slider holder with the pull hanging down. Further, the slider holder is adapted to lower together with the pull guide as it lowers, whereby the pull is allowed to pass from the second side to the first side of the fastener chain without being obstructed by the fastener tape strips.

The above and other objects, features and advantages of the present invention will become clear from the following description of the preferred embodiment thereof, taken in conjunction with the accompanying drawings.

DETAILED DESCRIPTION OF THE PREFERRED EMBODIMENT

Figure 1:
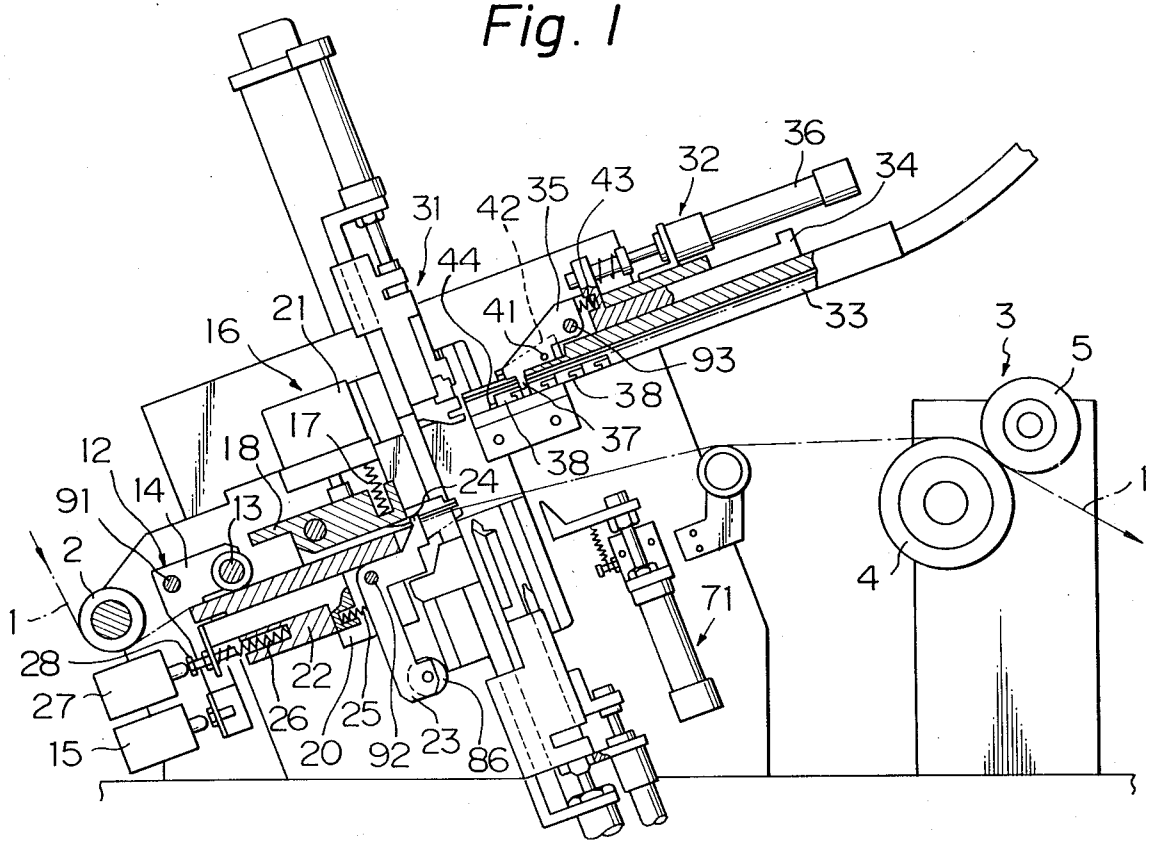
FIG. 1 is a partly-sectioned side elevational view of a concealed fastener slider inserting apparatus in accordance with the present invention.
Figure 2:
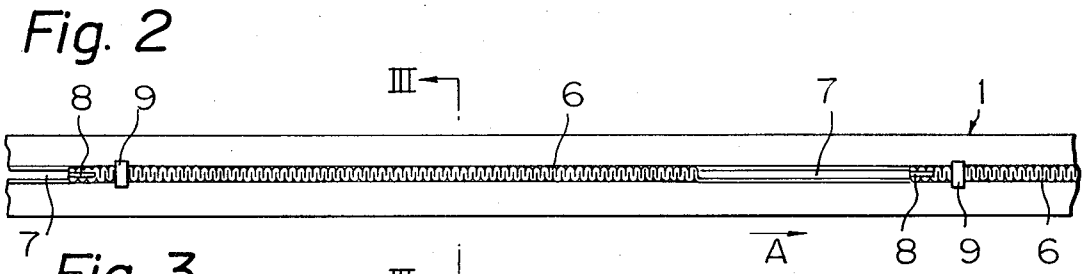
FIG. 2 is a plan view of a concealed fastener chain.
Figure 3:
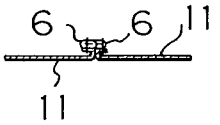
FIG. 3 is a sectional view taken along the line III—III of FIG. 2.

FIG. 1 is a partly-sectioned side elevational view of an apparatus for inserting a slider for a concealed fastener in accordance with the present invention. The apparatus is arranged such that a continuous fastener chain 1 is passed over a guide roller 2 and is advanced by a feed device 3. The feed device 3 has feed roller 4 and pressing roller 5. The fastener chain 1 has, as shown in FIG. 2, element rows 6 interlocked with each other and space portions 7 in which no element is present, the element rows 6 and the space portions 7 being disposed alternately. In the illustrated embodiment, each element row 6 is constituted by a coiled element member. A bottom stop 8 has previously been formed by a proper device, not shown, at a portion of the element rows 6 which is adjacent to the forwarding end of each space portion 7 in the advancing direction A of the fastener chain 1. It is to be noted that the reference numeral 9 denotes a movable stopper which is adapted to be moved to any desired position where it serves as a bottom stop. The fastener chain 1 is adapted to form a concealed fastener when it is cut into a predetermined length after having had a slider inserted thereinto and an upper stop secured thereto. Accordingly, each of the element rows 6 constituting the fastener chain 1 is, as shown in FIG. 3, sewn on the folded edge portion of a strip of tape 11.

As shown in FIG. 1, a space sensor 12 is provided on the downstream side of the guide roller 2. The sensor 12 has a roller 13 and a pivoting lever 14. The roller 13 is urged toward the element rows 6 by means of a spring, not shown. The roller 13 is adapted to enter a space portion 7 as it reaches the position of the roller 13 and to cause the lever 14 to pivot about a pin 91 in the clockwise direction as viewed in FIG. 1. The pivoting motion of the lever 14 actuates a limit switch 15. The switch 15 is adapted to change over the feed mode of the fastener chain 1 between high-speed and low-speed feed modes, as described later.

A brake device 16 is provided on the downstream side of the space sensor 12. The brake device 16 has a brake shoe 18 which is pressed against the fastener chain 1 by means of a spring 17, and a brake applying and releasing device 21 provided with a piston rod which is adapted to advance to a position where it further presses the brake shoe 18 against the fastener chain 1 thereby to prevent movement of the chain 1 and to withdraw to a position where it raises the brake shoe 18. The brake applying and releasing device 21 may be constituted by a solenoid or any desired device. The operating timing of the device 21 will be explained later. A stopper member 23 is pivotally attached through a pin 92 to a slide block 20 which is supported such as to be slidable with respect to a frame 22. The stopper member 23 has at its upper end a stopper projection 24. A spring 25 urges the stopper member 23 in the counterclockwise direction as viewed in FIG. 1 so that, when a space portion 7 reaches the position of the stopper member 23, the projection 24 automatically enters the space portion 7. When entering the space portion 7, the projection 24 engages an element at the rear edge of the space portion 7, whereby the slide block 20, together with the stopper member 23, is moved rightwardly as viewed in FIG. 1. The slide block 20 is constantly urged leftwardly as viewed in FIG. 1 by means of a spring 26. Accordingly, the slide block 20 normally presses a limit switch 27 by means of a bolt 28 provided thereon. When the projection 24 is rightwardly moved by a force applied thereto from the element at the rear edge of the space portion 7, the slide block 20 releases the limit switch 27 from the pressure of the bolt 28. When released, the limit switch 27 stops the operation of the feed device 3.

The manner in which stopper member 23 is released will be described later.

A slider holder device 31 and a slider supply device 32 are provided on the downstream side of the stopper member 23. The slider supply device 32 includes a chute 33 for sliders 38 which are supplied from a parts feeder (not shown), a pawl holder 34, and a pawl 35 which is pivotally attached to the pawl holder 34 by a pin 93. When the rod of an air cylinder 36 is expended, a projection 37 of the pawl 35 feeds out an endmost slider 38. When the rod of the air cylinder 36 is subsequently contracted, a cam follower 41 of the pawl 35 is moved onto a cam surface 42, whereby the pawl 35 is pivoted in the clockwise direction as viewed in FIG. 1 and is backwardly moved without any interference with a second slider 38. When the cam follower 41 comes off the cam surface 42, the pawl 35 is pivoted by the action of the spring 43 in the counterclockwise direction as viewed in FIG. 1, so that the projection 37 of the pawl 35 enters the space between the second and third sliders 38. The top slider 38 is maintained at its fed-out position by the action of the stopper 44. The stopper 44 may be changed in position or configuration such as to allow the slider 38 to pass when the rod of the air cylinder 36 is expanded for a subsequent feed operation. Thus, the sliders 38 are fed out, one by one, by the expansion and contraction of the rod of the air cylinder 36.

Figure 4:
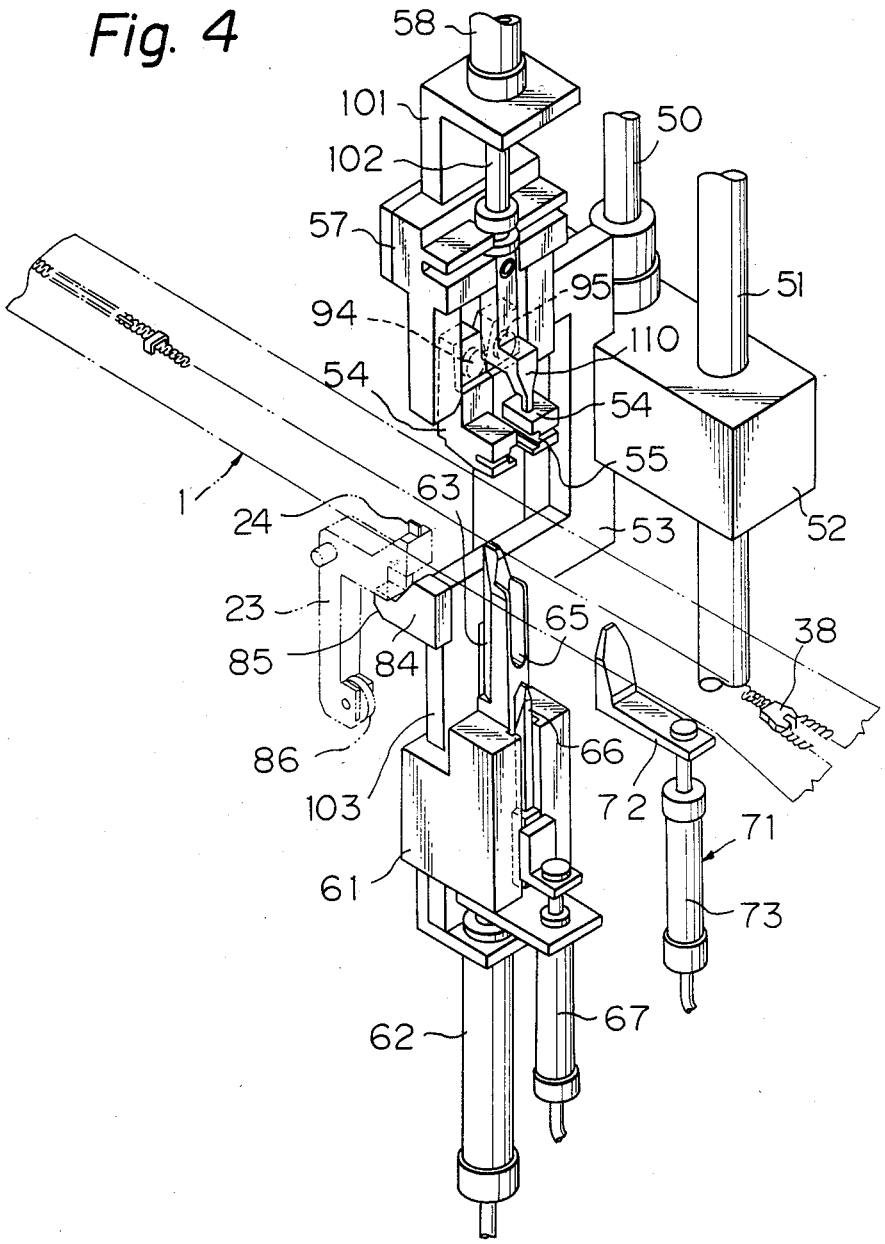
FIG. 4 is a perspective view of a slider holding device employed in the apparatus shown in FIG. 1.
Figure 5:
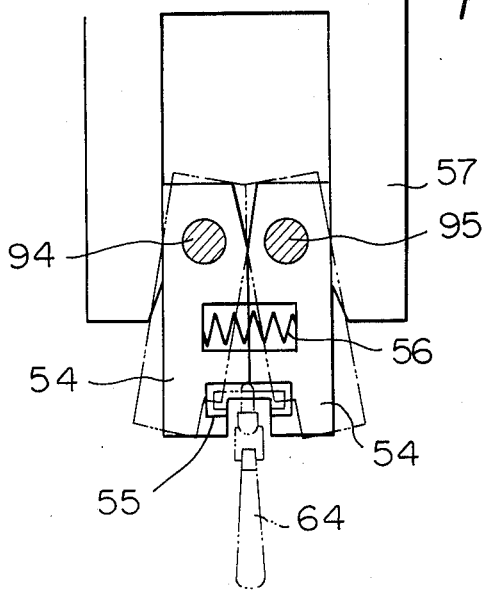
FIG. 5 is a segmentary view showing the details of slider holders in the slider holding device.

The slider holding device 31 will be described hereinunder with reference to FIG. 4. The slider holding device 31 has a crank-type frame 53 secured to a support block 52 which is adapted to vertically slide along a pair of right and left guide bars 51 (only one of them is illustrated) by means of a rod 50 of an air cylinder (not shown). A pair of slider holders 54 are pivotally attached to a vertical plate portion 101 constituting the upper part of the frame 53 by means of pins 94, 95, respectively. These holders 54 are arranged such as to define a single slider-holding recess 55 at their lower portions. As shown in FIG. 5, a compression spring 56 is fitted between the two holders 54, whereby the recess 55 is normally slightly expanded (i.e., the holders 54 are urged such that the lower portions thereof are located slightly outward of the solid-line positions in FIG. 5) in order to allow a slider 38 to be easily put in the recess 55. The vertical plate portion 101 constituting the upper part of the crank-type frame 53 is provided with a clamp device 57 such that it is slidable along the vertical plate portion 101. The clamp device 57 is formed such as to clamp the holders 54 from both sides thereof. The clamp device 57 is vertically moved by means of an air cylinder 58. After a slider 38 has been supplied into the recess 55, the clamp device 57 is lowered. Thereupon, as shown in FIG. 5, the holders 54 are inwardly pivoted such as to tightly hold the slider 38 within the recess 55.

When the piston rod 102 of the air cylinder 58 has been completely withdrawn, the holders 54 are largely opened as shown by the two-dot chain lines in FIG. 5 so as to release the slider 38 from being held. For this purpose, the air cylinder 58 is arranged such that it is possible to set the withdrawal amount of the piston rod 102 at two different values. Each of the upper and lower positions of the clamp device 57 may also be set at two positions by providing a proper stopper means for suspending the clamp device 57. A shutter 110 is secured to the clamp device 57. As the clamp device 57 is lowered, the shutter 110 reaches the region corresponding to the opening of the recess 55, thereby preventing the slider 38 from coming off the holders 54.

Figure 6:
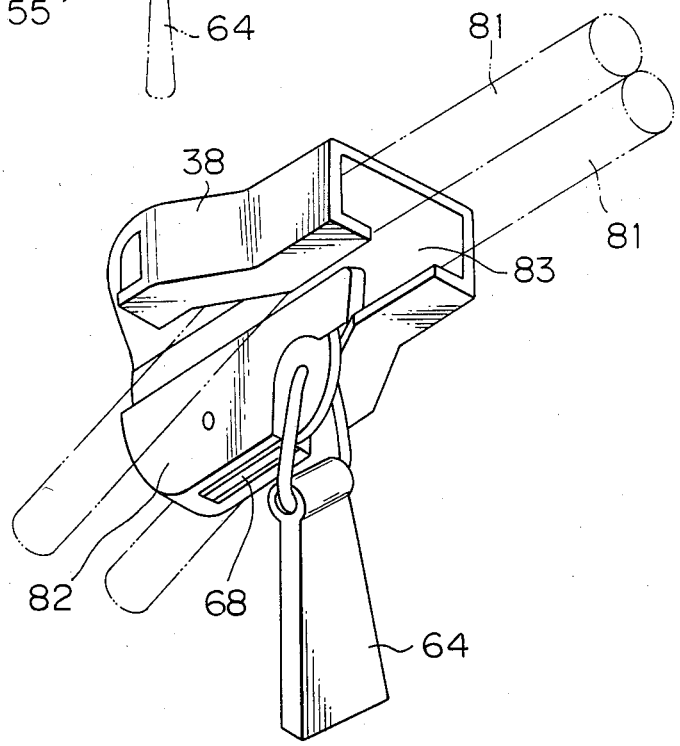
FIG. 6 is a perspective view of a slider.

A lower holder 61 is slidably supported by a vertical plate portion 103 constituting the lower part of the crank-type frame 53. The lower holder 61 is adapted to be vertically moved by an air cylinder 62. A pull guide 63 is secured to the lower holder 61. The pull guide 63 has its upper end reduced in width such as to easily enter the gap between the tape edge portions in a space portion 7. Further, the pull guide 63 has a pull groove 65 for housing a pull 64 (see FIG. 6) of the slider 38. The lower holder 61 further slidably supports a cover rod 66, which is vertically moved by an air cylinder 67 secured to the holder 61. When upwardly moved, the cover rod 66 presses a portion of a stopper pawl 68 (see FIG. 6) of the slider 38 such that the stopper pawl 68 is moved to a position where it is disengaged from the element rows 6, thereby allowing even a slider with an automatic stopper to be properly inserted. Further, when raised, the cover rod 66 closes the front opening of the pull groove 65, thus also serving to prevent the pull 64 from escaping from the pull groove 65.

The reference numeral 71 denotes a chain split device which has a wedge member 72 and an air cylinder 73 for vertically moving the wedge member 72. The function of the chain split device 71 will be explained later.

The following is a description of the operation of the fastener slider inserting apparatus.

After the insertion of one slider in to the fastener chain has been completed, the slide fastener chain 1 is advanced in the high-speed feed mode while receiving a slight frictional resistance by the spring 17 under the state wherein the piston rod of the brake applying and releasing device 21 is raised. When a subsequent space portion 7 reaches the position of the space sensor 12, the roller 13 enters the space portion 7. As a result, the limit switch 15 is actuated by the lever 14, whereby the operation mode of the feed device 3 is changed over to the low-speed feed mode. When the space portion 7 reaches the position of the stopper projection 24, the projection 24 is allowed to enter the space portion 7 by the action of the spring 25 and to engage an element at the rear edge of the space portion 7, thus causing the slide block 20 to move rightwardly as viewed in FIG. 1. The rightward movement of the slide block 20 causes the limit switch 27 to be released, so that the feed device 3 is suspended. At this time, the space portion 7 of the fastener chain 1 is placed at a position where it faces the slider holding device 31. At the same time, the brake shoe 18 is lowered by the associated piston rod such as to apply a proper degree of tension to the fastener chain 1.

Then, the slider holding device 31 is actuated. The operation of the slider holding device 31 is illustrated according to the process order from FIG. 7 to FIG. 12. The following description will be made with reference mainly to these drawings.

Figure 7:
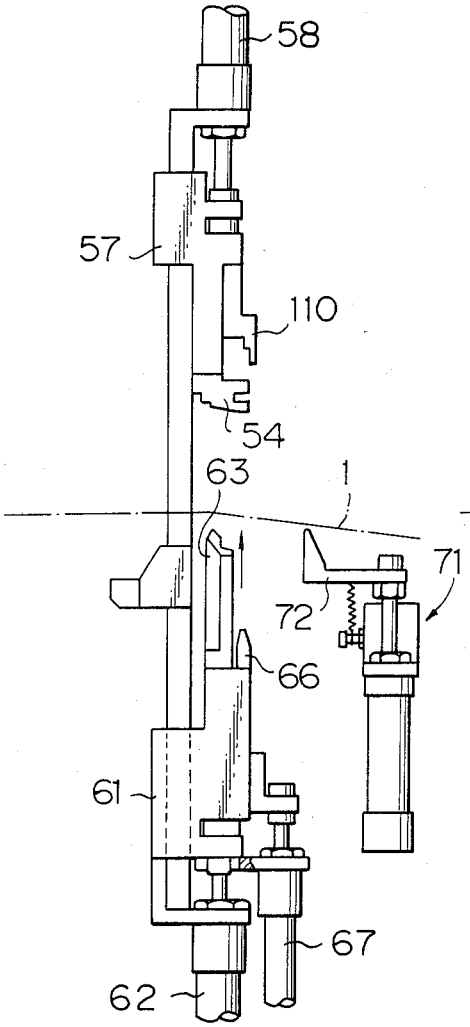
FIGS. 7 to 12 are illustrations respectively showing various steps of the slider inserting operation according to the process order.
Figure 8:
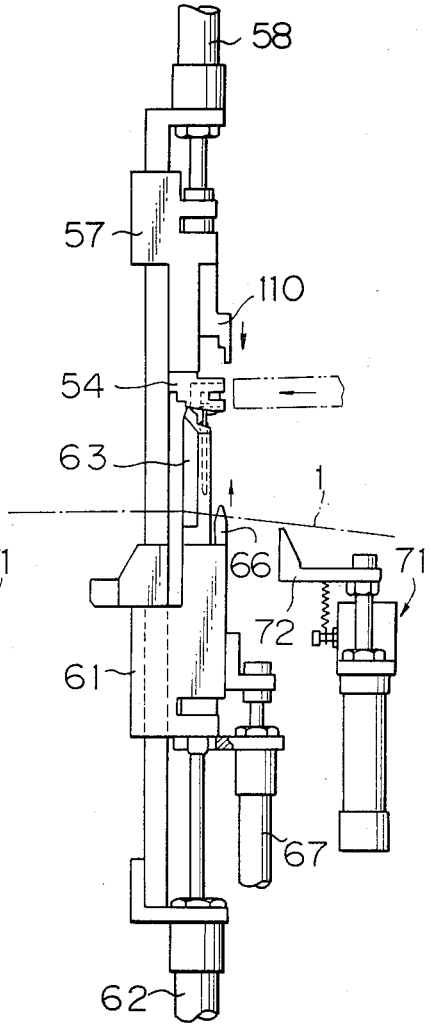

As shown in FIG. 7, first of all, the pull guide 63 is made to start moving upwardly by the air cylinder 62. The pull guide 63 wedges itself into the gap between the strips of tape 11 at the space portion 7 and further moves until the guide 63 comes in contact with the slider holders 54 or reaches a position where the former is adjacent to the latter as shown in FIG. 8. Then, a slider 38 is supplied into the slider holding recess 55 by the slider supply device 32. Thereafter, the clamp device 57 is lowered by the air cylinder 58, and at the same time, the shutter 110 is also lowered, whereby the slider 38 is reliably held within the recess 55. Under this state, the pull 64 has already been housed within the pull groove 65. After the slider 38 has thus been held, the cover rod 66 is raised, whereby the stopper pawl 68 is raised up, and at the same time, the opening of the pull groove 65 is closed, thereby wrapping the pull 64 within the pull groove 65.

Figure 13:
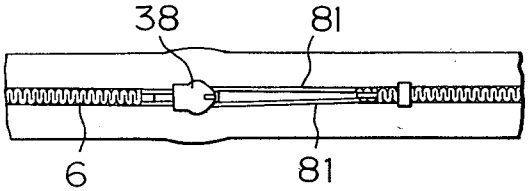
FIGS. 13 to 15 are plan views of the fastener chain, respectively showing the relationship between the slider and the fastener chain in various steps of the slider inserting operation according to the process order.

Next, the crank-type frame 53 as a whole is lowered by the rod 50 of the air cylinder, not shown, (see FIGS. 9 and 10), whereby the pull 64 is passed through the gap between the two strips of tape 11 while being housed in the pull groove 65. Under the state wherein the frame 53 has been completely lowered, the slider 38 is located at a position where it presses slightly downwardly respective beads 81 of the tape strips 11. Under this state, the fastener chain 1 has a proper degree of tension, and the beads 81 are slightly opened by a pull support 82 of the slider 38. Accordingly, the fastener chain 1 is allowed to smoothly enter the inlet-side portion of an element guide channel 83 in the slider 38 (see FIGS. 6 and 13). In the course of lowering of the frame 53, the cam surface 85 of a cam member 84 secured to the frame 53 engages a roller 86 which is provided at the lower end of the stopper member 23, thus causing the stopper member 23 to pivot in the clockwise direction as viewed in FIG. 1 and releasing the projection 24 from the space portion 7 (see FIG. 4). In consequence, the slide block 20 is moved leftwardly as viewed in FIG. 1 such as to actuate the limit switch 27 and to raise the brake shoe 18, thus removing all the pressing forces from the fastener chain 1 except for the pressing force applied thereto by the spring 17 and commencing the operation of the feed device 3. The feed operation in this case is carried out in a feed mode of a speed which is intermediate between the above-described high and low speeds.

Figure 14:
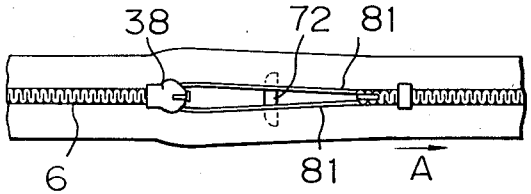
Figure 15:
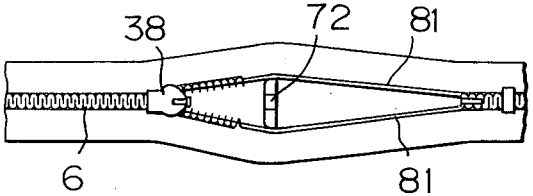
Figure 9:
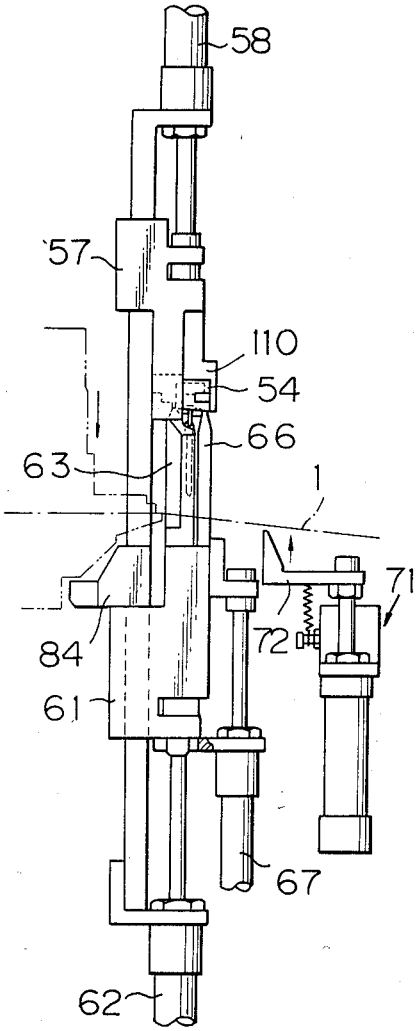
Figure 10:
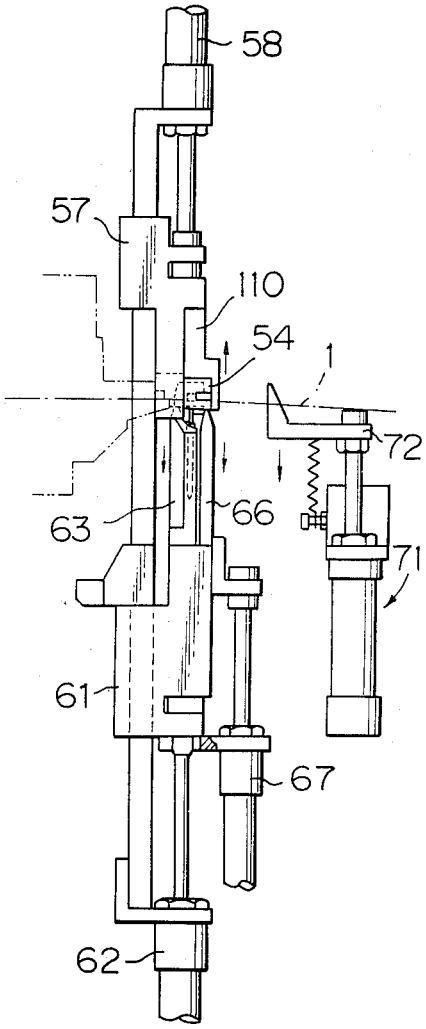
Figure 11:
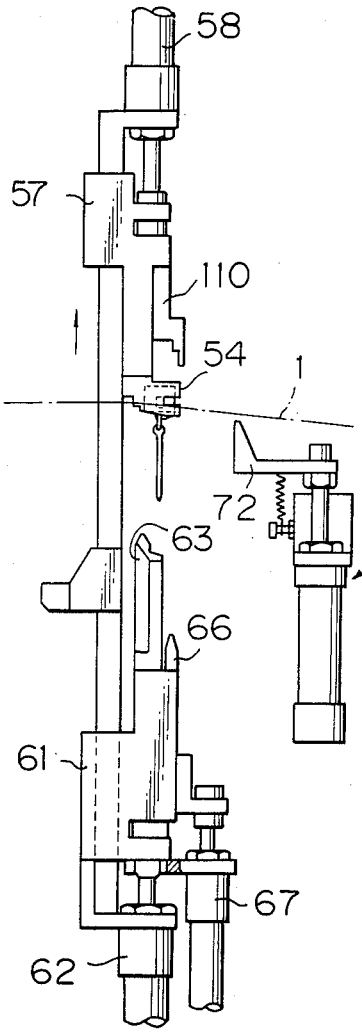
Figure 12:
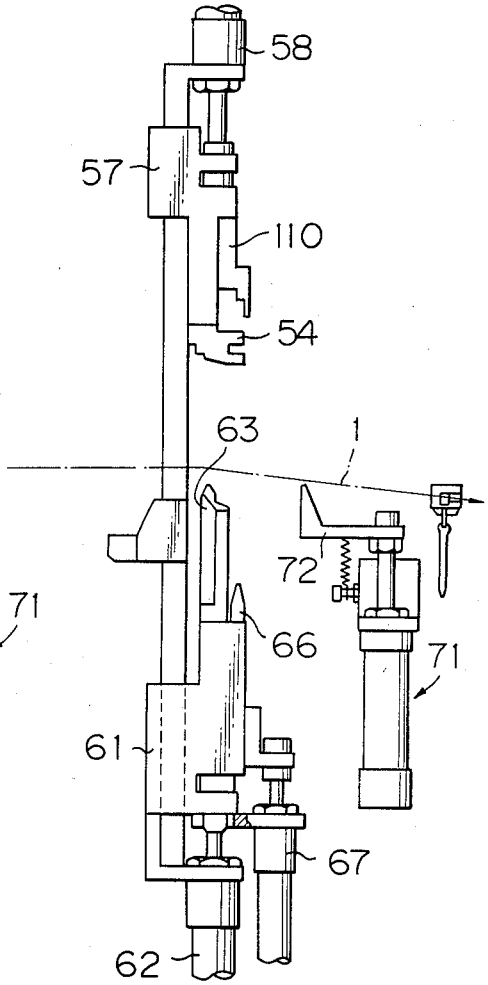

In the course of the lowering motion of the crank-type frame 53, the chain split device 71 commences its operation, so that the wedge member 72 thereof is caused to start moving upwardly (see FIG. 9). The wedge member 72 enters the gap between the beads 81 (see FIG. 14) after the beads 81 have been inserted into the inlet-side portion of the channel 83 in the slider 38. Thereafter, as the fastener chain 1 advances, the wedge member 72 enlarges the gap between the beads 81 (see FIG. 15) thereby to apply an outward force to each of the beads 81 so that the element rows 6 interlocked with each other are easily split by means of a diamond (not shown) which is provided inside the slider 38.

When the slider 38 has been inserted into the fastener chain 1 as far as a predetermined position thereon, the clamp device 57 is raised through the operation of a timer. At the same time, the pull guide 63, the cover rod 66 and the wedge member 72 are lowered (see FIG. 10), whereby the slider 38 is allowed to come out of the recess 55 which is open. Then, the frame 53 is raised (see FIG. 11), and the slider 38 moves with the fastener chain 1 (see FIG. 12). While the frame 53 is being raised, the limit switch, not shown, is actuated, so that the operation mode of the feed device 3 is changed over to the high-speed feed mode.

Then, a subsequent space portion 7 is sensed by the space sensor 12, and the same steps are repeated thereafter.

As has been described above, according to the present invention, the slider pull is allowed to automatically pass through the space portion of the fastener chain without being obstructed by the fastener tape strips, and the slider is maintained at a position where it is possible to insert the element rows into the slider. Thus, it becomes possible to automatically insert the slider in a forward insertion manner.

What is claimed is:

1. An apparatus for inserting a slider for a concealed fastener which inserts a slider into a continuous concealed fastener chain alternately having element rows interlocked with each other and space portions in which no element is present, said apparatus comprising:

a feed device which feeds said fastener chain;

a slider holding device;

a slider supply device which supplied a slider into said slider holding device; and a device which is adapted to sense said space portions and to stop said feed device such that said space portions are successively positioned with respect to said slider holding device, wherein said slider holding device includes: a slider holder which is adapted to receive a slider from said slider supply device and to support the same, with a pull of said slider hanging down; a device which moves said holder between an upper position where said slider is upwardly separate from said fastener chain and a lower position where said slider is in contact with said fastener chain so that bead portions of said fastener chain are allowed to be inserted into a channel in said slider; a pull guide having a pull groove which houses the pull of said slider; and a device which moves said pull guide between a lower position where said pull guide is downwardly separate from said fastener chain and an upper position where said pull guide extends such as to pass through one of the space portions of said fastener chain and to come in contact with or be adjacent to the slider within said slider holder, and wherein, when said pull guide is moved from said upper position to said lower position, said slider holder is moved from said upper position to said lower position together with said pull guide.

2. An apparatus for inserting a slider for a concealed fastener according to claim 1 wherein said slider holder and said pull guide are supported on a mutual frame so as to be lowered in one body by lowering of said frame.

3. An apparatus for inserting a slider for a concealed fastener according to claim 1, wherein said pull guide is supported on a lower holder having cover means which is adapted to selectively cover said pull grove of the pull guide.

* * * * *